US006122227A

United States Patent [19]

Kuo

[11] Patent Number: 6,122,227

[45] Date of Patent: Sep. 19, 2000

[54] TIMER

[76] Inventor: Chu-Rong Kuo, 12F, No. 367, Han Kou Road, Sec. 4, Taichung, Taiwan

[21] Appl. No.: 09/229,123

[22] Filed: Jan. 12, 1999

[51] Int. Cl.[7] ..... G04F 8/00

[52] U.S. Cl. ..... 368/109; 368/72; 368/89; 368/107; 368/108

[58] Field of Search ..... 368/72–75, 45, 368/12, 107–109, 89, 250

[56] References Cited

U.S. PATENT DOCUMENTS

| | | | |
|---|---|---|---|
| 4,410,774 | 10/1983 | Houpt et al. | 368/107 |
| 5,095,468 | 3/1992 | Sato | 368/72 |
| 5,568,452 | 10/1996 | Kronenberg | 368/72 |

*Primary Examiner*—Diego Gutierrez
*Assistant Examiner*—Jeanne Goodwin
*Attorney, Agent, or Firm*—Browdy and Neimark

[57] ABSTRACT

A timer is made up of a base unit and an operation unit. The base unit is composed of a support body, a disk, and a core located between the support body and the disk. The disk is provided with a retaining ring having an indentation, and a timing scale. The core has a rotary shaft extending toward the disk. The operation unit consists of a lower housing, an upper housing, an action member, and an elastic member. The upper housing has a cylindrical portion provided with a sliding portion and a shaft fastening portion. The shaft fastening portion is provided with an axial hole in which the rotary shaft of the core of the base unit is retained. The upper housing is disposed on the lower housing and provided with a pointer corresponding in location to the scale of the disk of the base unit. The action member has a body corresponding to the cylindrical portion of the lower housing, a retaining portion corresponding to the retaining ring of the disk, and a position confining portion corresponding to the sliding portion of the upper housing. The elastic member is disposed in the cylindrical portion of the lower housing for urging the action member.

7 Claims, 3 Drawing Sheets

TIMER

FIELD OF THE INVENTION

The present invention relates generally to a timer, and more particularly to a timer which is versatile in design and function.

BACKGROUND OF THE INVENTION

The conventional timers are generally limited in use in view of the fact that they are not compatible with nonelectrical appliances. In addition, the conventional timers are devoid of dynamic means for alerting effectively their users of the conclusion of an event at a predetermined time.

SUMMARY OF THE INVENTION

The primary objective of the present invention is to provide a versatile timer which is compatible with all kinds of appliances and is provided with dynamic motion and sound effects to alert effectively its user of the conclusion of an event at a predetermined time.

It is another objective of the present invention to provide a timer which is ornamentally constructed to serve as a desirable household or office adjunct.

In keeping with the principle of the present invention, the foregoing objectives of the present invention are attained by a timer consisting mainly of a base unit and an operation unit. The base unit is composed of a support body, a disk, and a core located between the support body and the disk. The disk is provided with a retaining ring having an indentation, and a timing scale. The core has a rotary shaft extending toward the disk. The operation unit consists of a lower housing, an upper housing, an action member, and an elastic member. The upper housing has a cylindrical portion provided with a sliding portion and a shaft fastening portion. The shaft fastening portion is provided with an axial hole in which the rotary shaft of the core of the base unit is retained. The upper housing is disposed on the lower housing and provided with a pointer corresponding in location to the scale of the disk of the base unit. The action member has a body corresponding to the cylindrical portion of the lower housing, a retaining portion corresponding to the retaining ring of the disk, and a position confining portion corresponding to the sliding portion of the upper housing. The elastic member is disposed in the cylindrical portion of the lower housing for urging the action member.

The structures, functions and features of the present invention will be more readily understood upon a thoughtful deliberation of the following detailed description of a preferred embodiment of the present invention with reference to the drawings provided herewith.

DETAILED DESCRIPTION OF THE INVENTION

Figure 1:
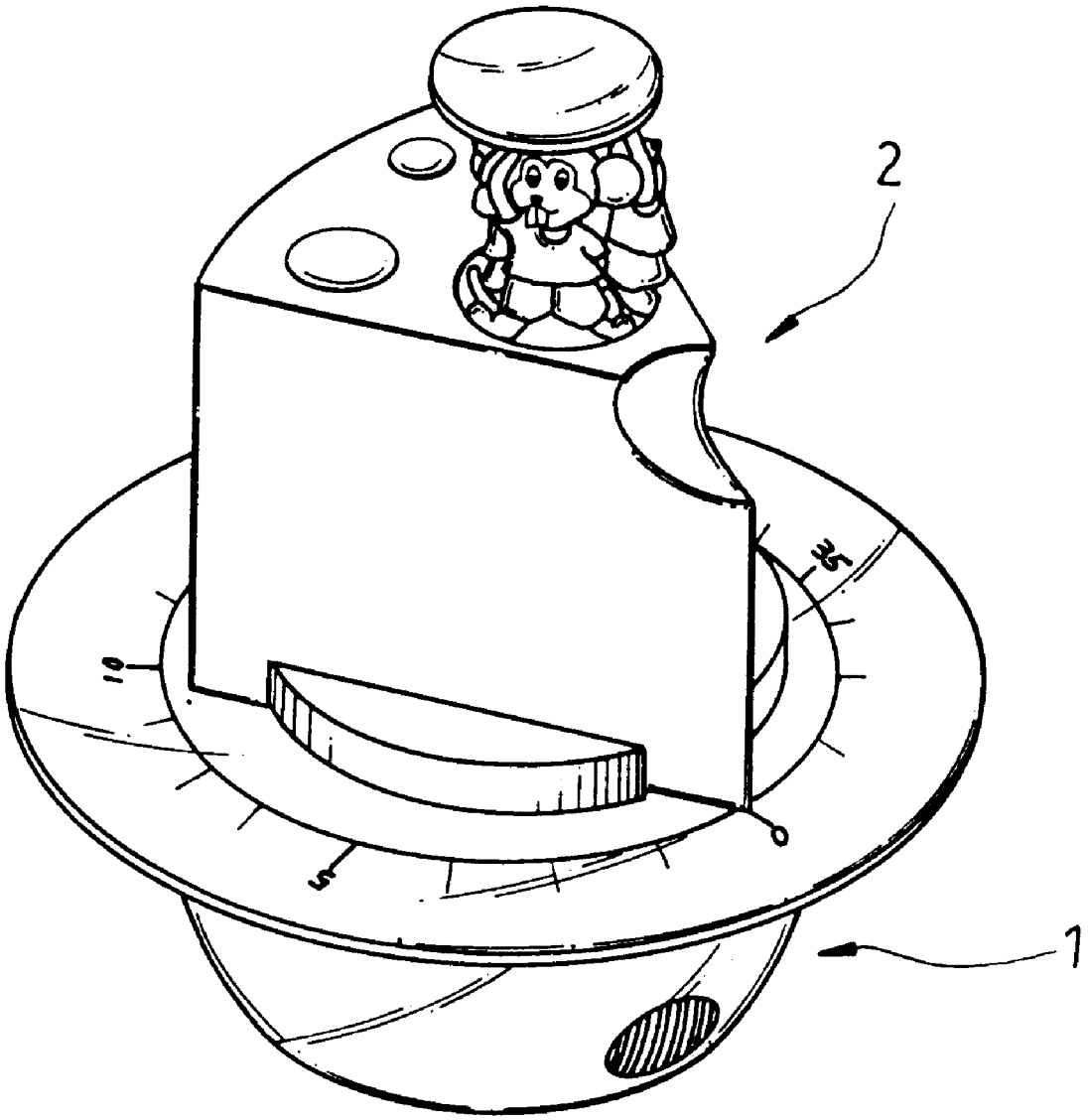
FIG. 1 shows a perspective view of the preferred embodiment of the present invention.
Figure 2:
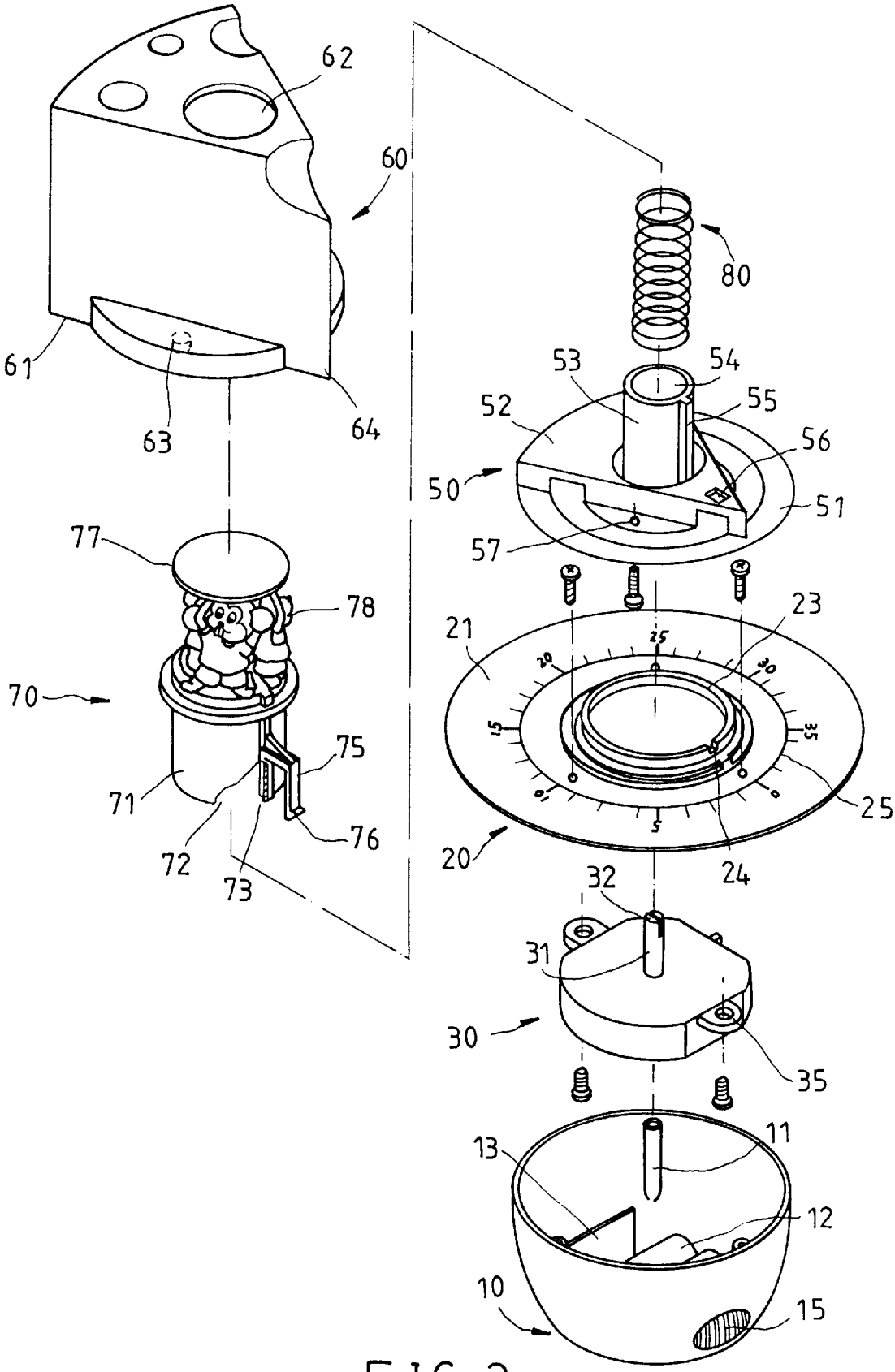
FIG. 2 shows an exploded view of the preferred embodiment of the present invention.

As shown in FIGS. 1 and 2, a timer embodied in the present invention is composed of a base unit 1 and an operation unit 2 mounted on the base unit 1. The base unit 1 consists of a support body 10, a disk 20, and a core 30.

The support body 10 has three fastening portions 11 located along the periphery thereof, a battery set 12 located under the fastening portions 11, and a sounding unit 13 connected with the battery set 12 and provided with three sound holes 15.

The disk 20 is fastened with the three fastening portions 11 of the support body 10 by three screws and provided with a disk body 21, a retaining ring 23 located at the center thereof and provided with an indentation 24, and a scale 25 located on the disk body 21.

The core 30 is fastened with the underside of the disk 20 and provided at the center thereof with a rotary shaft 31 which is in turn provided at the free end thereof with a retaining groove 32. The core 30 is further provided with two fastening portions 35 opposite in location to each other. A switch connection point (not shown in the drawings) is connected with the sounding unit 13. The core 30 is in fact a prior art structure.

The operation unit 2 consists of a lower housing 50, an upper housing 60, an action member 70, and an elastic member 80.

The lower housing 50 has a bottom 51, a fitting portion 52 located at the upper portion thereof, a cylindrical portion 53 located at the center thereof and provided therein with an inner hole 54, a slide rail 55 located in the periphery of the cylindrical portion 53, a through hole 56, a shaft fitting column 58 having an axial hole 581 in which the rotary shaft 31 of the core is received. The shaft fitting column 58 is provided at the top end thereof with a retaining key 582 which can be retained in the retaining groove 32 of the core 30.

The upper housing 60 is disposed on the lower housing 50 and provided with a fitting portion 61 which is engaged with the fitting portion 52 of the lower housing 50. The upper housing 60 is further provided with a movable hole 62, two fastening portions 63 which are fastened with the lower housing 50, and a pointer 64 for indicating the scale 25 of the disk 20.

The action member 70 is of a cylindrical construction and is composed of a body 71 which is provided with an inner hole 72, a slide slot 73, an extension rod 75 having a retaining portion 76, an urging portion 77, and a puppet 78.

The elastic member 80 is a compression spring and is disposed in the inner hole 54 of the cylindrical portion 53 of the lower housing 50 such that one end of the elastic member 80 urges the bottom of the action member 70, and that other end of the elastic member 80 urges the lower housing 50. As a result, the action member 70 can be pushed out by the elastic force of the elastic member 80.

As shown in FIG. 2, the core 30 is disposed under the disk 20 such that the rotary shaft 31 of the core 30 is jutted out of the disk 20. The elastic member 80 is disposed in the cylindrical portion 53 of the lower housing 50. The action member 70 is fitted over the cylindrical portion 53 such that the slide slot 73 is corresponding in location to the slide rail 55, and that the top end of the action member 70 is corresponding to the movable hole 62 of the upper housing 60. The upper housing 60 is fitted over the action member 70 and the elastic member 80 such that the bottom of the upper housing 60 is fastened with the lower housing 50. The rotary shaft 31 of the core 30 is received in the axial hole 581 of the lower housing 50 such that the retaining key 582 is retained in the retaining groove 32.

Figure 3:
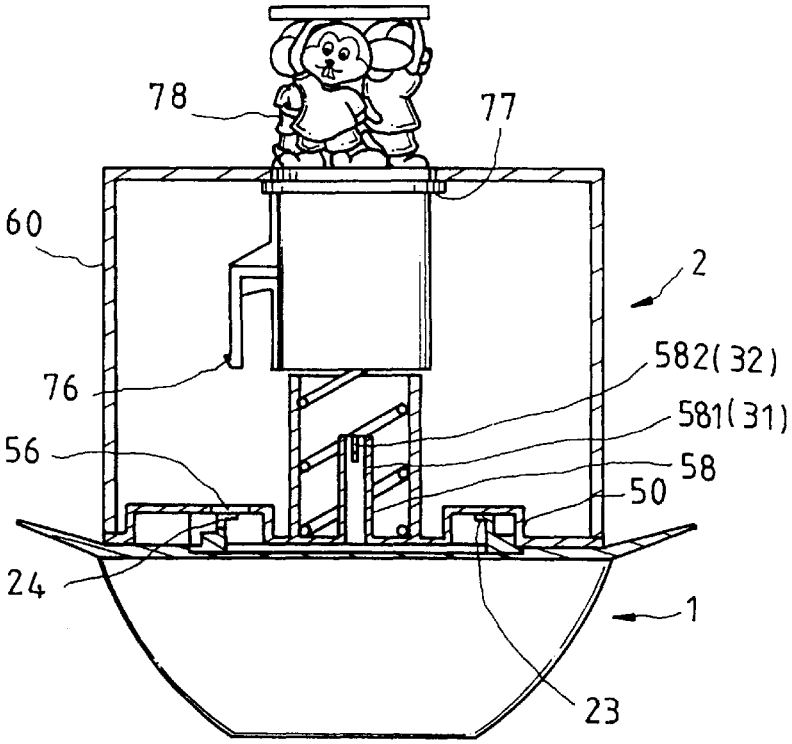
FIG. 3 is a side sectional view of the preferred embodiment of the present invention not in a timing state.

As shown in FIG. 3 and other drawings provided herewith, the pointer 64 of the upper housing 60 points at "0" of the scale 25 of the disk 20. The present invention is therefore not in a timing state. In order to set the present invention in a timing state, the action member 70 must be first pressed so as to cause the retaining portion 76 of the action member 70 to insert into the retaining ring 23 of the disk 20. Thereafter, the operation unit 2 is turned clockwise such that the pointer 64 points at a desired mark of a series of timing marks of the scale 25, thereby causing the shaft fitting column 58 of the lower housing 50 to actuate the rotary shaft 31 of the core 30 to turn so as to set the timer of the present invention in a timing state.

Figure 4:
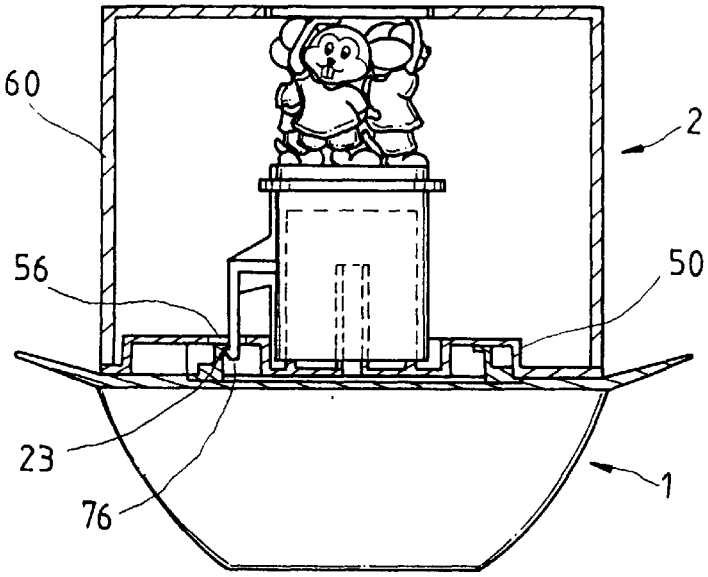
FIG. 4 shows a side sectional view of the preferred embodiment of the present invention in a timing state.

As shown in FIG. 4 and other drawings provided herewith, the rotary shaft 31 of the core 30 turns counter-clockwise at the time when the timer is in the timing state. The operation unit 2 is thus actuated by the rotary shaft 31 to turn. As the predetermined time is up, the retaining portion 76 of the action member 70 is located at the indentation 24 of the disk 20. The action member 70 is ejected by the elastic force of the elastic member 80 such that the urging portion 77 of the action member 70 is retained in the movable hole 62 of the upper housing 60, and that the puppet 78 is visible. In the meantime, the sounding unit 13 is activated by the core 30 to give forth a predetermined musical tune to alert the user of the timer of the end of an event.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A timer comprising a base unit and an operation unit mounted on said base unit;

wherein said base unit comprises:

a support body provided with a receiving space;

a disk disposed on said support body and provided with a retaining ring having an indentation, and a scale having a series of timing marks; and a core fastened with the underside of said disk and provided with a rotary shaft fastened therewith such that said rotary shaft faces said disk;

wherein said operation unit comprises:

a lower housing having a cylindrical portion, and a shaft fastening portion for retaining said rotary shaft of said core, said cylindrical portion provided with a sliding portion;

an upper housing disposed on said lower housing and provided with a movable hole and a pointer corresponding in location to said scale of said disk;

an action member having a body corresponding in location to said cylindrical portion of said lower housing, a retaining portion engageable with said retaining ring of said disk, and a position confining portion corresponding in location to said sliding portion of said lower housing; and an elastic member located in said cylindrical portion of said lower housing such that said elastic member urges said action member;

said retaining portion of said action member being retained in said indentation of said disk at the time when said action member is exerted on by an external force, thereby enabling said operation unit to rotate such that said retaining portion of said action member is turned into said retaining ring of said disk, and that said rotary shaft of said core is turned so as to place the timer in a timing state;

said action member being ejected by said elastic member at the time when said retaining portion of said action member returns to a position corresponding in location to said indentation of said disk, so as to terminate the timing state of the timer.

2. The timer as defined in claim 1, wherein said rotary shaft of said core is provided with a retaining groove; wherein said shaft fastening portion of said lower housing has a shaft fitting column and a retaining key; wherein said rotary shaft of said core is inserted into said shaft fitting column; and wherein said retaining key is retained in said retaining groove of said core.

3. The timer as defined in claim 2, wherein said sliding portion of said lower housing is a slide rail; and wherein said position confining portion of said action member is a slide slot.

4. The timer as defined in claim 1, wherein said base unit farther comprises a sounding unit connected with said core, and a battery set connected with said sounding unit.

5. The timer as defined in claim 1, wherein said lower housing and said upper housing are made integrally.

6. The timer as defined in claim 1, wherein said support body and said disk are made integrally.

7. The timer as defined in claim 1, wherein said action member is provided at the top thereof with a puppet.

* * * * *